US006360492B1

(12) United States Patent
Ross

(10) Patent No.: US 6,360,492 B1
(45) Date of Patent: Mar. 26, 2002

(54) PORTABLE SHADE SHELTER FOR SMALL AIRCRAFT

(76) Inventor: James M. Ross, 823 Amber La., Anaheim Hills, CA (US) 92807

( * ) Notice: Subject to any disclaimer, the term of this patent is extended or adjusted under 35 U.S.C. 154(b) by 0 days.

(21) Appl. No.: 09/595,602

(22) Filed: Jun. 15, 2000

(51) Int. Cl.[7] ..... E04B 7/16

(52) U.S. Cl. ..... 52/66; 52/72; 52/174; 52/23; 135/97; 135/124

(58) Field of Search ..... 52/66, 72, 86, 52/23, 174, 234, 64; 49/40; 135/97, 124; 47/17

(56) References Cited

U.S. PATENT DOCUMENTS

| | | | | | |
|---|---|---|---|---|---|
| 1,350,493 | A | | 8/1920 | Goodrich | |
| D75,199 | S | | 5/1928 | Ahlborn | |
| D138,436 | S | | 8/1944 | Clark | |
| 2,532,456 | A | | 12/1950 | Merritt | |
| 2,610,366 | A | | 9/1952 | McKee et al. | |
| 2,664,597 | A | | 1/1954 | McKee et al. | |
| 2,837,780 | A | | 6/1958 | Younger | |
| 3,009,211 | A | * | 11/1961 | Hansen et al. | 52/66 |
| 3,229,649 | A | * | 1/1966 | Baker | 52/66 |
| 3,234,695 | A | * | 2/1966 | Johnson | 52/66 |
| 3,261,134 | A | * | 7/1966 | Crist | 52/66 |
| 3,766,691 | A | | 10/1973 | Ray | |
| 3,818,652 | A | * | 6/1974 | Pierce | 52/23 |
| 4,014,133 | A | | 3/1977 | Brown | |
| 4,067,347 | A | * | 1/1978 | Lipinski | 52/66 |
| 4,175,361 | A | | 11/1979 | Kumode | |
| 4,280,306 | A | | 7/1981 | Milinic | |
| 4,348,833 | A | * | 9/1982 | Nagoya | 52/66 |
| 4,542,759 | A | | 9/1985 | Kyner, Jr. | |
| 4,716,691 | A | * | 1/1988 | Allen et al. | 52/6 |
| 5,507,121 | A | | 4/1996 | Taylor | |
| 5,598,668 | A | * | 2/1997 | Isom | 52/86 |
| 5,870,872 | A | * | 2/1999 | Hinnen et al. | 52/49.1 |
| 6,260,308 | B1 | * | 7/2001 | Looney | 52/63 |

FOREIGN PATENT DOCUMENTS

| | | |
|---|---|---|
| WO | WO98/00625 | 2/1998 |

* cited by examiner

*Primary Examiner*—Beth A. Stephan
*Assistant Examiner*—Dennis L. Dorsey
(74) *Attorney, Agent, or Firm*—Gene Scott-Patent Law & Venture Group

(57) ABSTRACT

An enclosure for sheltering a small aircraft, provides an arcuate roof frame supported by a base frame. The roof frame has a fixed roof portion engaging a movable roof portion and a crank system for adjusting the position of the movable roof. Wing cushions contact the wings of the small aircraft as it is backed into the enclosure and assure that the craft is properly placed. The fixed and movable roof portions are mutually engaged by a rolling clamping system enabled for directing arcuate motion of the movable roof portion relative to the fixed roof portion. A spring-biased awning is engaged with the movable roof portion and extends forwardly. A fabric cover is mounted between the fixed and movable roofs so as to deploy the fabric cover when the movable roof portion is extended.

8 Claims, 7 Drawing Sheets

PORTABLE SHADE SHELTER FOR SMALL AIRCRAFT

The present application takes legal notice of a Document Disclosure previously filed with the United States Patent Office and which has an official Ser. No. 470973 and an assigned filing date of Mar. 16, 2000 and which contains subject matter substantially the same as that described and claimed in the present application.

BACKGROUND OF THE INVENTION

1. Field of the Invention

This invention relates generally to light weight and portable shelters and more particularly to an enclosure for sheltering a small aircraft.

2. Description of Related Art

The following art defines the present state of this field:

Ahlborn, U.S. Pat. No. D75,199 relates to the ornamental design for an airplane hanger.

Clark, U.S. Pat. No. D138,436 relates to the ornamental design for an implement shed.

Goodrich, U.S. Pat. No. 1,350,493 describes a knock down building, including joists, supports, and a connecting member for securing the supports to the joists comprising a body portion, wings extending along the longitudinal edges of the body portion and bent at right angles thereto to form a socket for the reception of the end of a joist and spaced apart wings at one end of the body portion bent at right angles thereto and spaced from the first mentioned wings and lying in a plane at right angles to the planes of said first wings and forming a socket for the reception of the end of the supports.

Merritt, U.S. Pat. No. 2,532,456 describes an in door construction, a door member, an inwardly projecting frame carried by said door member, means for pivotally mounting the inner end of said frame for swinging movement about a horizontal axis, and arcuate extension movably bodily with said door member and forming a component part thereof, a vertically disposed cantilever-type supporting post structure having one end thereof secured to a stationary foundation and disposed immediately adjacent to said door member extension in concentric relation about the axis of turning movement of said door member, an arcuate guide formed by said post structure, antifriction devices carried by said extension and engageable in the guide of said post structure, and counterbalancing means for said member carried by said extension.

McKee et al., U.S. Pat. No. 2,610,366 describes a building having a wall formed substantially horizontally disposed cylinder, said wall having an opening to form a doorway therein, a door for closing said opening, said door also being formed as a portion of a cylinder and being located within said building and behind said wall, said door being sufficiently rigid to be self-supporting, a single horizontal pivot to the rear of said door and adjacent each end thereof, supports for said pivots, a pair of arms attached to the door at each end thereof and rotatably mounted on the adjacent pivot whereby said door can be swung into an overhead position about an axis established by said pivots, sealing means on the peripheral edges of the front face of said door and cooperating curved jambs bordering said doorway opening, the vertically extending peripheral edges of said door and said sealing means conforming in curvature to the curvature of the jambs to adapt the door to be brought into sealing engagement with said jambs when the door is in its lowermost position, one arm of each pair being shorter than the other whereby said pivots are eccentrically located relative to the axis of curvature of said doorjamb so as to break the bond between said sealing means and said jamb upon initial upward movement of the door from closed position.

McKee et al., U.S. Pat. No. 2,664,597 describes a counterbalanced door for a building having a wall formed substantially as a portion of a substantially horizontally disposed cylinder, and wherein the wall has an opening to form a doorway therein, said door being located within the building and behind said wall, said door being sufficiently rigid to be self-supporting and having rearwardly extending A-shaped supporting arms at opposite ends thereof, said arms having horizontal pivot points adjacent their apices whereby said door can be swung into an overhead open position about an axis established by said pivot points, a pair of counterweights, a cable attached to each counter weight, and overhead pulley for each cable, and means attaching each cable to one of said arms intermediate its apex and said door, said means being constructed so that the total weight of the counterweights multiplied by their effective lever arm about said pivotal axis is equal to the total weight of the door times its effective lever arm about said pivotal axis for all positions of the door.

Younger, U.S. Pat. No. 2,837,780 describes an airplane hangar having a floor level and a door opening above said floor level, a door panel adapted to register with said opening when said panel is closed, a compartment below said floor level for receiving said panel when the latter is open, said door panel being curved along its vertical extent to a circular arc, said panel being provided with a rigid extension extending into said compartment when said panel is closed, a pair of rollers in said compartment and respectively engaging opposite side of said extension for providing a couple resisting the couple due to the action of gravity on said panel when said panel is closed, means for swinging said panel through its circular arc about the center of curvature of said panel between said open and closed positions with said rollers in rolling engagement with said panel at all times.

Ray, U.S. Pat. No. 3,766,691 describes a swimming pool enclosure comprising a plurality of arched supporting beams which extend from ground level up over an area to be enclosed, and a series of panel members arranged between each adjacent pair of supporting beams and hinged to one another for movement along such beams between extended enclosing positions and retracted open positions, the panels in the latter positions being folded and stacked relative to one another.

Pierce, U.S. Pat. No. 3,818,652 describes a portable apparatus for shelter and protection of small airplanes which may be utilized with standardized mooring ring arrays existing at small craft mooring areas of airports. The apparatus is of inexpensive, light-weight pre-fabricated design such that it is capable of rapid assembly and disassembly, ease of tranport, yet strudy weather-resistant stability; the components of the pre-fabricated structure are constructed along essentially planar design with rectangular/parallel bracing, and in assembled form they constitute a main housing for receiving the fuselage of the airplane and oppositely extending wind coverage nacelles extending on each side of the main housing in position to receive the wings of the airplane. The structure is readily adaptable to receive any of the many types of small aircraft or it may be converted with aid of special accessory structure to receive the larger twin engine aircraft.

Brown, U.S. Pat. No. 4,014,133 describes a greenhouse structure for growing vegetables, flowers, and like plants inside under good conditions particularly in the fall, winter, and early spring portions of the year includes a building structure having a rear wall and opposite end walls and a roof defining an enclosed space having an open front side and a closure member movable between an open position and a closed position with the closure member being adapted to close the open front side of the building structure. Power means are operatively connected to the closure member for moving same between the open position and the closed position in response to temperature measurement within the building structure for controlling some growing conditions of the plants.

Kumode, U.S. Pat. No. 4,175,361 describes an openable canopy housing having a series of movable, telescoping transparent arched panels which form the combination roof and sides. Part of the roof of the housing is formed by a horizontal beam which runs the length of the structure. The transparent panels can be selectively opened or closed to provide a structure which can be used for indoor as well as outdoor use.

Milinic, U.S. Pat. No. 4,280,306 describes a convertible tennis-court enclosure, comprising a plurality of parallel supporting beams and two closure elements between two of the supporting beams to be extended simultaneously along the supporting beams, each element including a series of purlins arranged to slide on the supporting beams and connected in two's by a portion of a canvas fixed to the purlins, of which the length is equal to half that of the beams.

Kyner, Jr., U.S. Pat. No. 4,542,759 describes a geodesic type shelter having the shape of a semi-ellipsoid of revolution having a large opening in one side and being constructed of elements which are all removably connected together so that it is particularly useful as a portable airplane hangar.

Taylor, U.S. Pat. No. 5,507,121 describes a garage generally comprises a pair of side walls that are vertical, parallel and semi-circular, and a peripheral wall spanning between the periphery of the side walls to form an enclosure. The peripheral wall includes a front door and a rear door. Front and rear door support paths are located on the inside of each side wall near the wall's peripheral edge. Each door path is parallel, semi-circular and supports a side edge of a door. The front and rear door paths are of different radius such that the door panels may overlap. Latching mechanisms, located at approximately midway up on the marginal side of each side wall are moveable to a latching position connecting a door to side walls such that the door cannot slide and such that the door prevents the side walls from outward movement at that location.

Meyer, WO 98/06625 describes a sound proof hangar for airplanes with a wide entrance for aircraft. To provide a sound barrier at the open side, the entrance opening is limited, at least on one side, by a series of deflecting surfaces, the inner edges of which are directed, in horizontal section towards the hangar interior and the external edges of which are directed laterally. The deflecting surfaces can be moved between a closed position which partly or completely closes the entrance opening and a position which opens the entrance opening.

The prior art teaches a variety of enclosures and hangers and especially doors for such, knock-down buildings, portable structures, and especially teaches arcuate door structures. However, the prior art does not teach a structure as herein disclosed and claimed having advantages as described in the following summary.

SUMMARY OF THE INVENTION

The present invention teaches certain benefits in construction and use which give rise to the objectives described below.

The present invention is an enclosure for sheltering a small aircraft, and provides an arcuate roof frame supported by a base frame. The roof frame has a fixed roof portion engaging a movable roof portion and a crank system for adjusting the position of the movable roof. Wing cushions contact the wings of the small aircraft as it is backed into the enclosure and assure that the craft is properly placed. The fixed and movable roof portions are mutually engaged by a rolling clamping system enabled for directing arcuate motion of the movable roof portion relative to the fixed roof portion. A spring-biased awning is engaged with the movable roof portion and extends forwardly. A fabric cover is mounted between the fixed and movable roofs so as to deploy the fabric cover when the movable roof portion is extended.

A primary objective of the present invention is to provide a shelter or enclosure for small aircraft having advantages not taught by the prior art.

Another objective is to provide such an invention having a relatively small footprint.

A further objective is to provide such an invention manufacturable at low cost.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
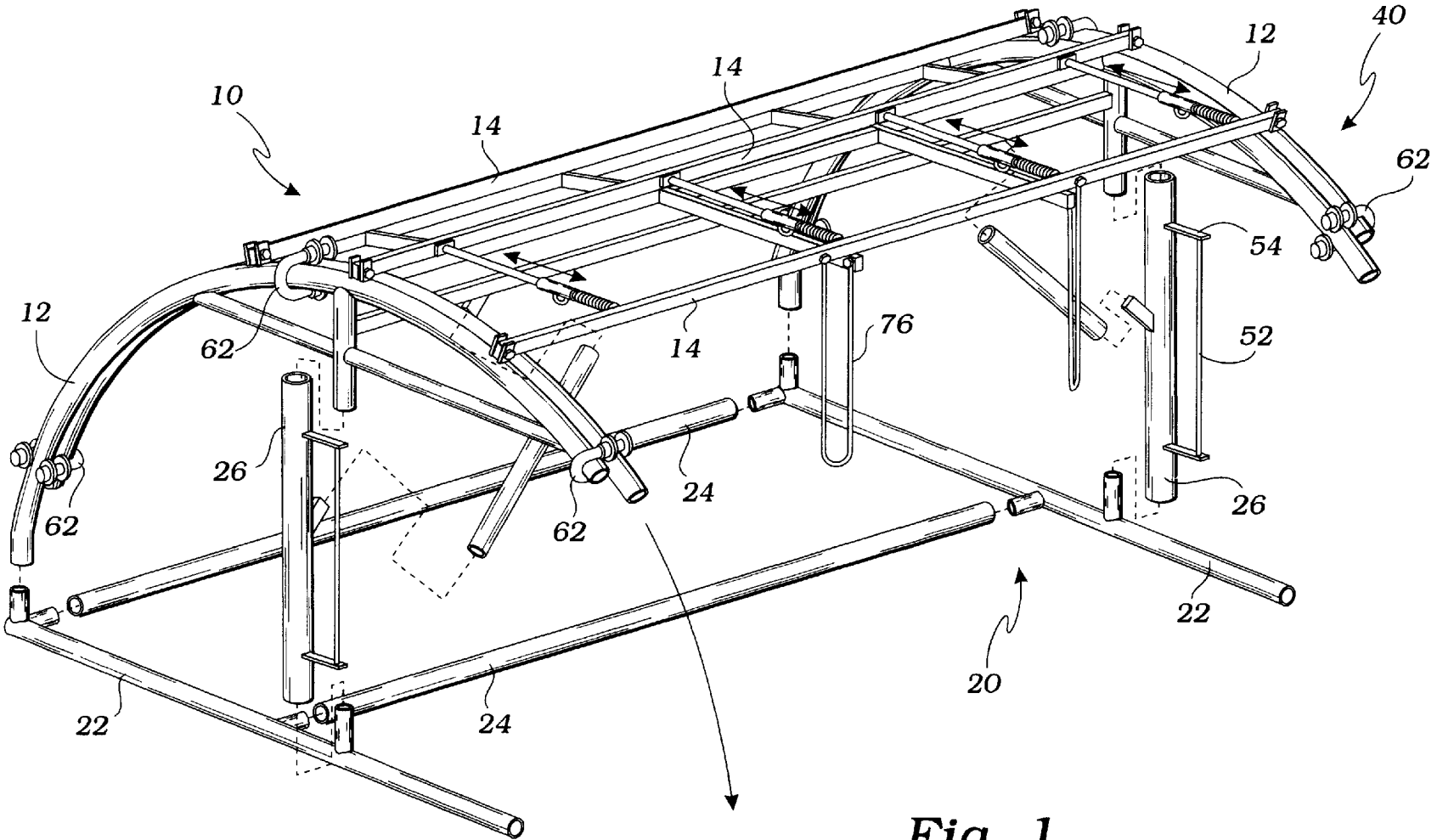
FIG. 1 is a perspective view of the preferred embodiment of the invention showing a movable roof portion of the invention in a retracted position.
Figure 2:
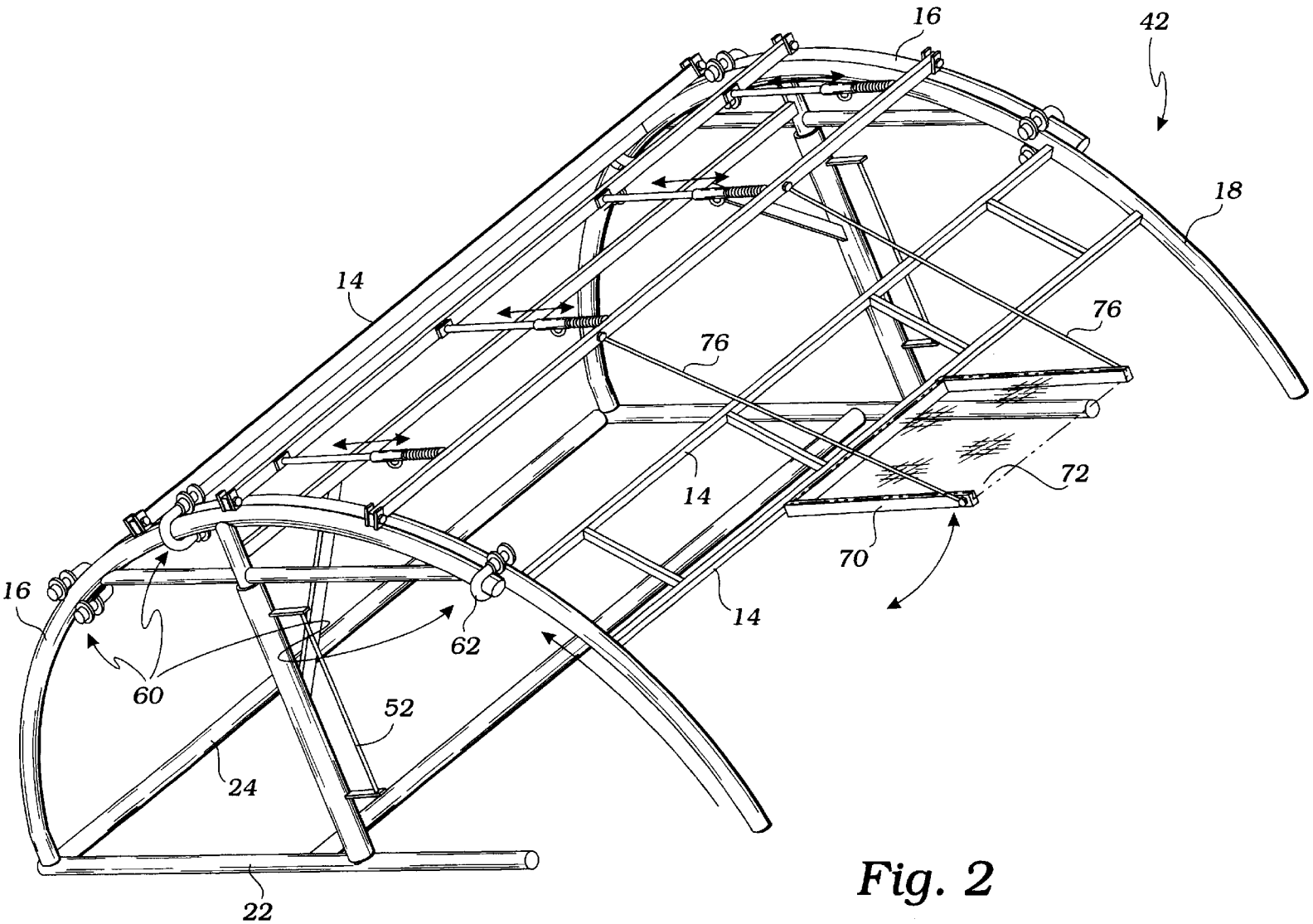
FIG. 2 is similar to FIG. 1 but showing the roof in an extended position.
Figure 3:
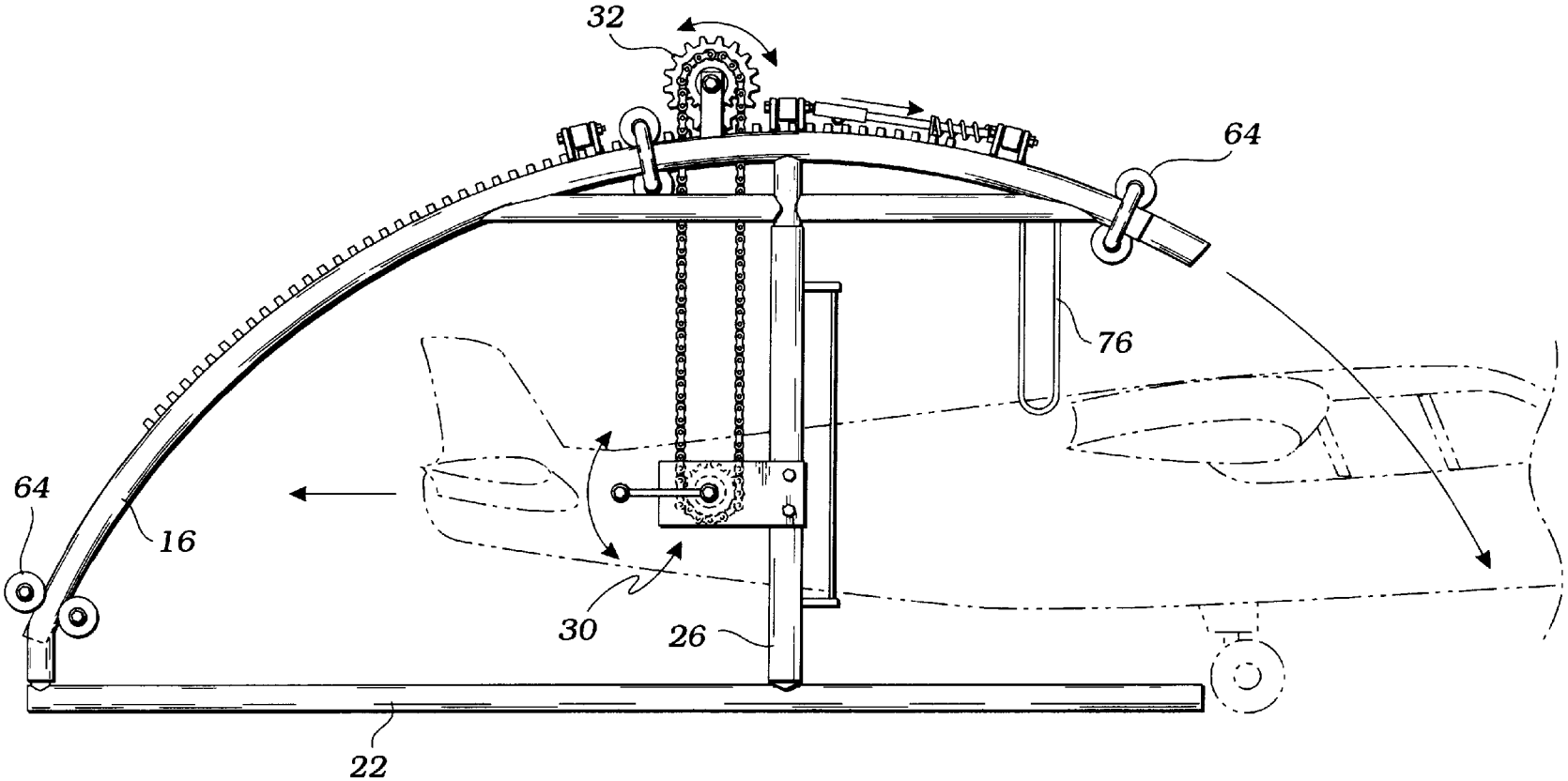
FIG. 3 is a left side elevational view of FIG. 1.

The above described drawing FIGS. 1–8 illustrate the invention, an apparatus, hereinafter referred to as the "enclosure," for providing shelter and shade for a small aircraft (not a part of the invention), i.e., a small frame building able to enclose the majority, but not all, of a small aircraft such as a Cessna 182 or the like. An arcuate roof frame 10 comprises a pair of spaced apart arcuate shaped roof side members 12 joined by a plurality of transverse roof beams 14. The arcuate roof frame 10 is supported above a base frame 20. The arcuate roof frame 10 provides a fixed roof portion 16 engaging a movable roof portion 18 as seen best in the top plan view of FIG. 6. A mechanized means 30 for adjusting the movable roof portion 18 between a retracted position 40 (FIGS. 1, 3, 5 and 7) and an extended position 42 (FIGS. 2, 4, 6, and 8) is provided, the extended position 42 is forward of the retracted position 40. The base frame 20 provides a pair of side braces 22 joined by a pair of transverse braces 24, the side and transverse braces 22, 24 are adapted for resting on a surface, such as an aircraft parking area, for supporting the enclosure, and further provide a pair of upwardly extending columns 26 joining the arcuate roof side beams 12 to the side braces 22 for supporting the arcuate roof frame 10 above the support surface. The arcuate roof side members 12 and the transverse roof beams 14 are positioned for creating a sheltered space 5 large enough to accept a fuselage of the small aircraft within the enclosure, however, the wings of the aircraft protrude outwardly from the enclosure on either side. The movable roof portion 18, when in the extended position 42, provides clearance for the nose of the aircraft's fuselage.

Figure 4:
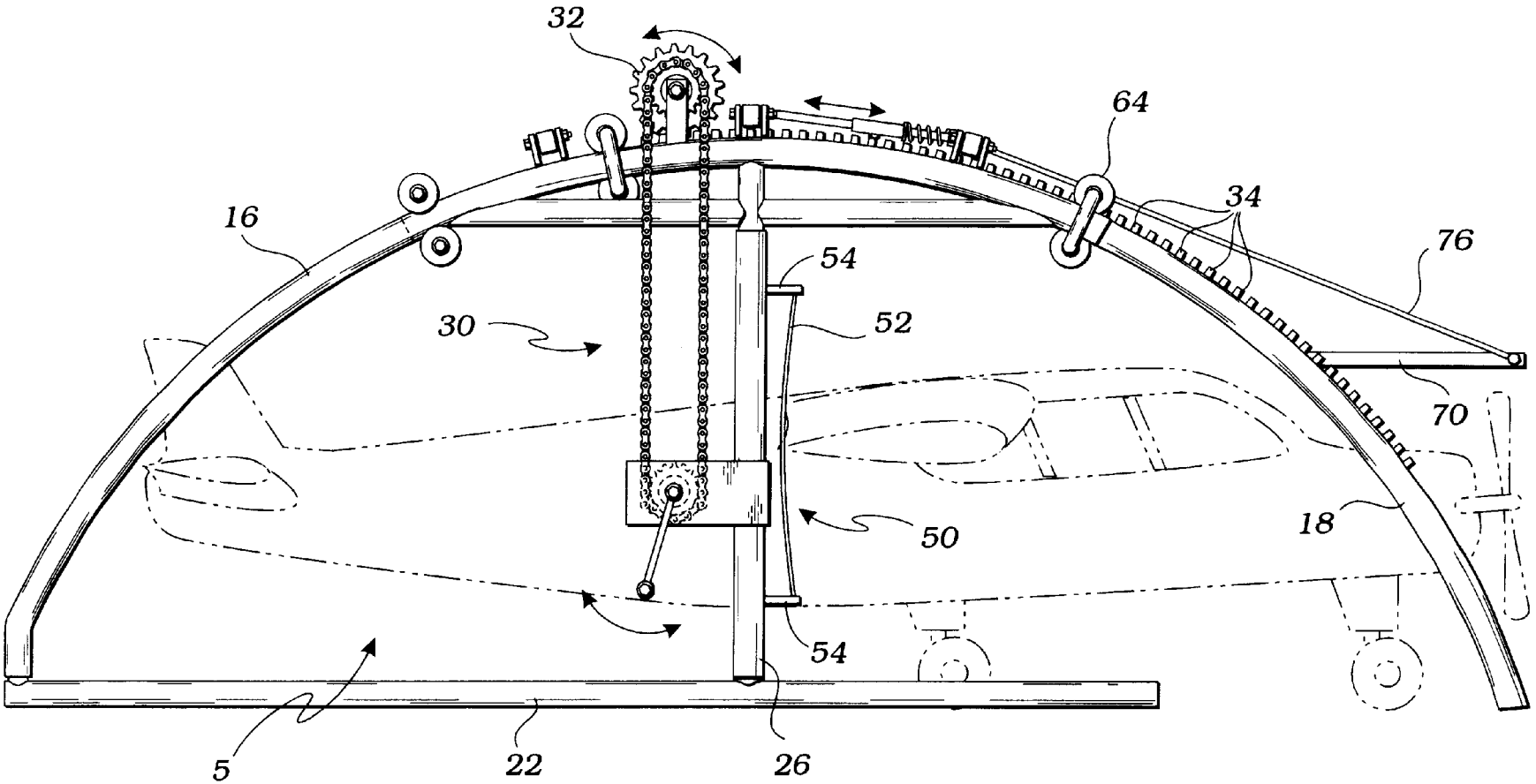
FIG. 4 is a left side elevational view of FIG. 2.

The present invention further comprises a pair of wing cushioning means 50 adapted and positioned for receiving resilient contact with a pair of wings of the small aircraft and this allows the aircraft to be backed into the enclosure until the wings contact the cushioning means 50 whereupon the aircraft is assumed to be correctly positioned within the enclosure and able to be tied down and wheels blocked. As shown in FIG. 4, the cushioning means 50 comprises an elastic band or bar 52 stretched or mounted between two standoffs 54. The cushioning means 50 includes two such assemblies, one on each side of the aircraft.

The fixed roof portion 16 and the movable roof portion 18 are mutually engaged by a rolling clamping means 60 enabled for directing arcuate motion of the movable roof portion 18 relative to the fixed roof portion 16. The rolling clamping means 60 preferably includes a set of at least three rolling clamps 62 on each side of the enclosure. Each of these rolling clamps 62 include two wheels 64 held rigidly in place on either the fixed or the moving roof portion 16, 18 and bearing the load of the moving roof portion 18 as they direct its motion in parallel with the fixed roof portion 16 between the retracted and extended positions 40 and 42 respectively.

Figure 5:
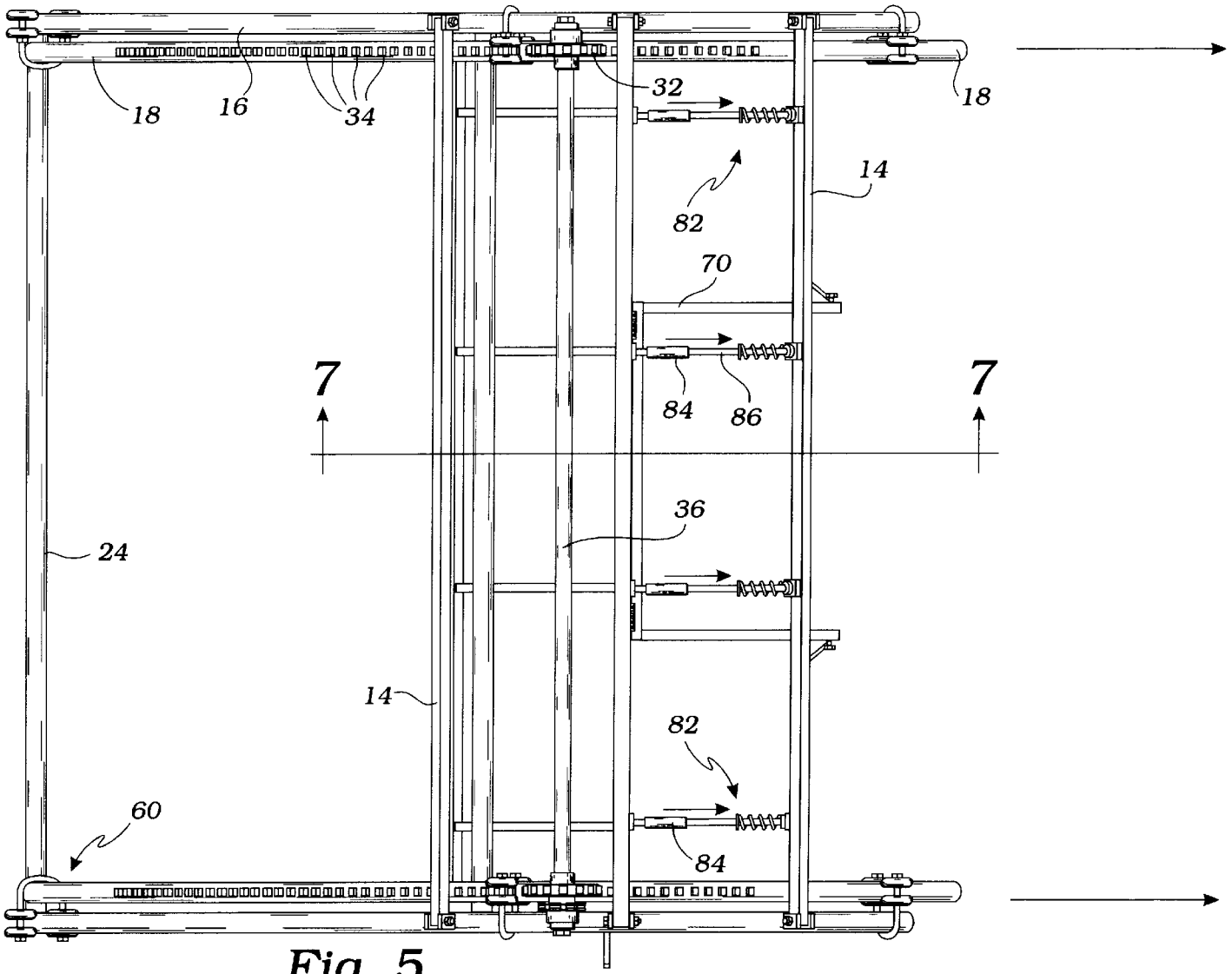
FIG. 5 is a top plan view of FIG. 1.

The mechanized means for adjusting 30 is a cranking system engaging a drive sprocket 32, the drive sprocket 32 further engaging a linear sequence of teeth 34 mounted along the movable roof portion 18 for movement between the retracted 40 and extended 42 positions. As shown in FIG. 5, the drive sprocket 32 and the teeth 34 are mounted on both moving roof portions (on either side) and the two sprockets 32 are joined for rotation together by shaft 36 extending laterally across the enclosure.

Figure 8:
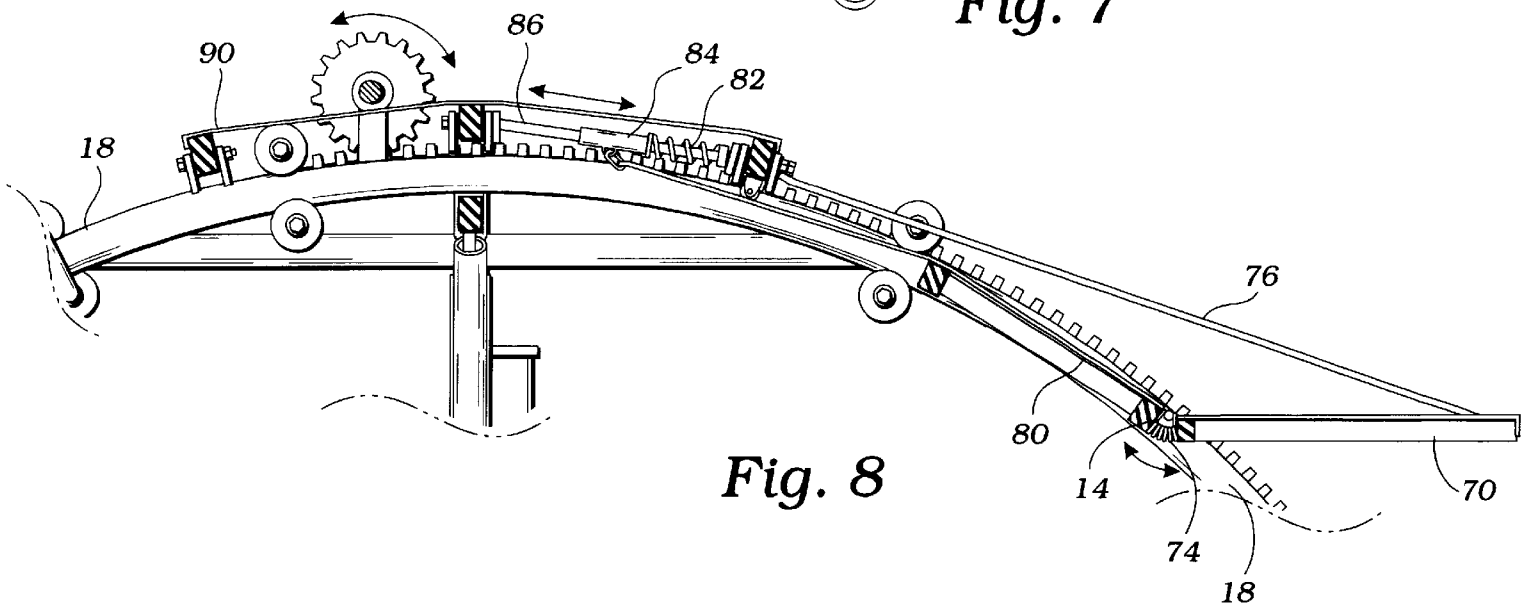
FIG. 8 is a sctional view taken along line 8—8 in FIG. 6.

A spring-biased awning frame 70 supports a fabric shade 72 which is mounted by common hardware within the frame 70. The awning frame 70 engages the movable roof portion 18 and extends forwardly from it. A spring set 74 (FIG. 8) is used to mount the awning frame 70 to the leading transverse roof member 14. A tether 76 is positioned for drawing the awning frame 70 upwardly as the movable roof portion 18 is extended so as to avoid contact between the fabric shade 72 and the small aircraft. This relationship is best shown in FIG. 8.

Figure 6:
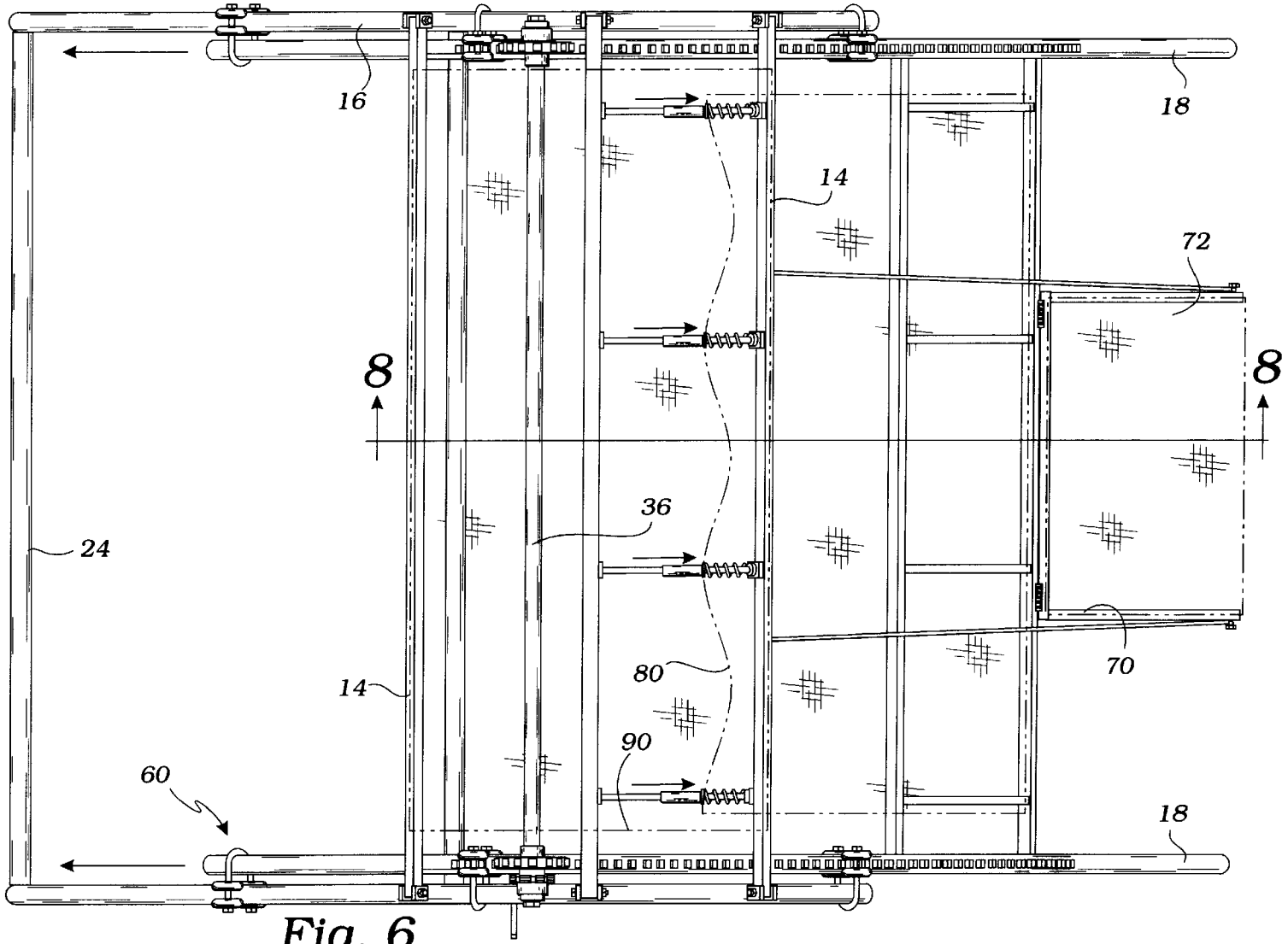
FIG. 6 is a top plan view of FIG. 2.
Figure 7:
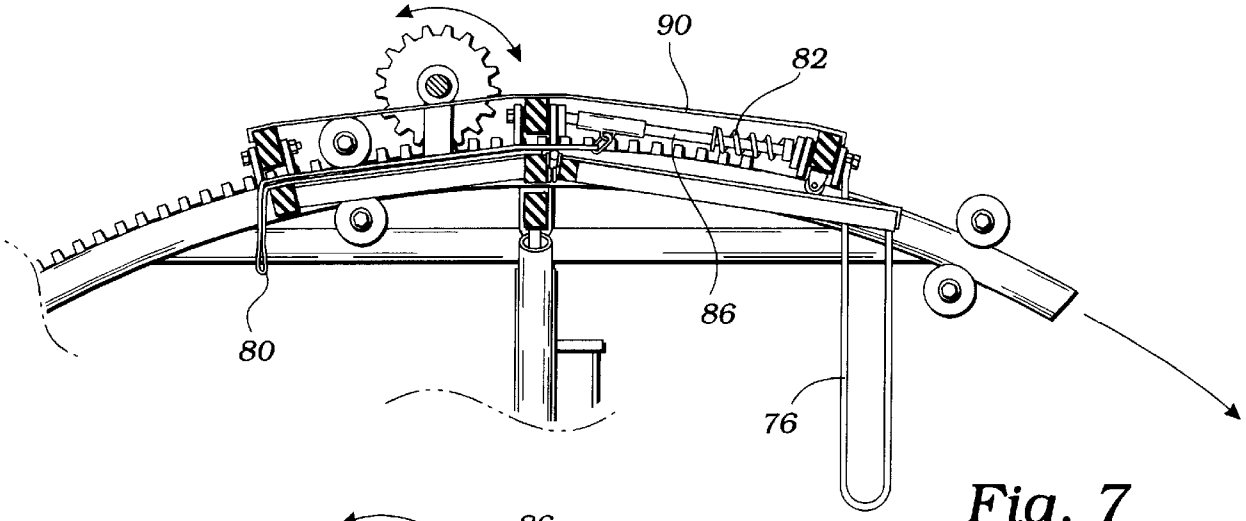
FIG. 7 is a sectional view taken along line 7—7 in FIG. 5.

A retractable fabric cover 80 is mounted between the fixed roof portion 16 and the movable roof portion 18, as shown in FIG. 6 outlined with phantom lines so as not to obscure details of the frame structures. The fabric cover 80 is deployed automatically when the movable roof portion 18 is extended and is withdrawn automatically when the movable roof portion 18 is retracted. Refer to FIGS. 7 and 8 to observe the cover 80 in retracted and extended positions. The fabric cover 80 is joined to the fixed roof portion 18 with a spring system 82 comprising a set of springs, as shown, and a set of corresponding collars 84 in sliding engagement with a set of shafts 86, such that upon deployment, the fabric cover 80 is stretched taught by compressing the springs, and upon retraction, the collars are able to freely slide along the shafts 86 rearwardly to more fully uncover and allow the use of less fabric in fabric cover 80. In addition to the retractable fabric cover 80, the present invention also employs a fixed fabric cover 90 mounted onto the fixed roof portion 16 at transverse beams 14 by common hardware (not shown). The edges of covers 80 and 90 are shown with phantom lines in FIG. 6.

In operation, the enclosure is generally set-up at an airport where it may be placed at any location where small aircraft are allocated. Fabric may be used to enclose the entire enclosure, or it may be left generally open. With movable roof portion 18 in the retracted position 40 a sheltered aircraft may be moved out of the enclosure in the forward direction. When the aircraft is returned to the enclosure, it is backed into it until the wings contact cushioning means 50. The movable roof portion 18 may then be extended so that the entire aircraft is shaded from direct overhead sunlight. As stated, further covers may be applied to all sides of the frame so as to fully enclose it as desired.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus for sheltering a small aircraft, the apparatus comprising:

an arcuate roof frame comprising spaced apart arcuate roof members joined by transverse roof beams, the arcuate roof frame supported above a base frame;

the arcuate roof frame providing a fixed roof portion engaging a movable roof portion;

a mechanized means for adjusting the movable roof portion between a retracted position and an extended position, the extended position of the movable roof portion being forward of the retracted position;

the base frame providing side braces joined by transverse braces, the side and transverse braces adapted for resting on a surface for supporting the apparatus, and further providing upwardly extending columns joining the arcuate roof side members to the side braces for supporting the arcuate roof frame above the support surface;

the arcuate roof side members and the transverse roof beams adapted by size and position for accepting a fuselage of the small aircraft within the apparatus;

whereby, with the movable roof portion in the extended position, clearance for the nose of the fuselage is provided.

2. The apparatus of claim 1 further comprising a pair of wing cushioning means adapted and positioned for receiving resilient contact with a pair of wings of the small aircraft.

3. The apparatus of claim 1 wherein the fixed roof portion and the movable roof portion are mutually engaged by a rolling clamping means enabled for directing arcuate motion of the movable roof portion relative to the fixed roof portion.

4. The apparatus of claim 1 wherein the mechanized means for adjusting is a cranking system engaging a drive sprocket, the drive sprocket further engaging a linear sequence of gear teeth of the movable roof portion for movement thereof between the retracted and extended positions.

5. The apparatus of claim 1 further providing a spring-biased awning frame for mounting a fabric shade thereon, the awning frame engaging the movable roof portion and extending forwardly thereof.

6. The apparatus of claim 5 further providing a tether positioned for drawing the awning frame upwardly as the movable roof portion is extended so as to avoid contact between the fabric shade and the small aircraft.

7. The apparatus of claim 1 further providing a fabric cover mounted between the fixed roof portion and the movable roof portion so as to deploy the fabric cover when the movable roof portion is extended and to withdraw the fabric cover when the movable roof portion is retracted.

8. The apparatus of claim 7 wherein the fabric cover is joined to the fixed roof portion with a spring system such that upon deployment, the fabric cover is stretched taught.

* * * * *